US006997577B1

(12) United States Patent
Pepito et al.

(10) Patent No.: US 6,997,577 B1
(45) Date of Patent: Feb. 14, 2006

(54) ORNAMENTAL LIGHTING ASSEMBLY

(76) Inventors: Alvin M. Pepito, 306 W. Country Hills Dr., La Habra, CA (US) 90631; Lota P. Pepito, 306 W. Country Hills Dr., La Habra, CA (US) 90631

( * ) Notice: Subject to any disclaimer, the term of this patent is extended or adjusted under 35 U.S.C. 154(b) by 157 days.

(21) Appl. No.: 10/636,334

(22) Filed: Aug. 7, 2003

(51) Int. Cl.
*F21V 21/005* (2006.01)

(52) U.S. Cl. ..... 362/249; 362/252; 362/311

(58) Field of Classification Search ..... 362/145, 362/184, 151, 152, 255, 249, 391, 323, 329, 362/300, 310, 806–812, 252, 253, 435–439; 40/409, 410; 109/135
See application file for complete search history.

(56) References Cited

U.S. PATENT DOCUMENTS 3,302,013 A * 1/1967 Richardson ..... 362/311
3,704,365 A * 11/1972 Miller ..... 362/294
5,317,238 A 5/1994 Schaedel
5,860,731 A 1/1999 Martinez
5,918,967 A 7/1999 Land
5,957,564 A 9/1999 Bruce et al.
6,224,239 B1 * 5/2001 Adler ..... 362/252
6,394,624 B1 * 5/2002 Hsu ..... 362/249
6,398,387 B1 6/2002 Wienhold
6,494,591 B1 * 12/2002 Guimond ..... 362/249
6,811,283 B1 * 11/2004 Kovacs ..... 362/249

FOREIGN PATENT DOCUMENTS

CA 2309877 A1 * 12/2001

OTHER PUBLICATIONS

Publication of Unknown Origin—Plastic Icicles.

* cited by examiner

*Primary Examiner*—Sandra O'Shea
*Assistant Examiner*—Hargobind S. Sawhney
(74) *Attorney, Agent, or Firm*—Eric Karich

(57) ABSTRACT

An ornamental lighting assembly has a base member, a clip member, and an ornament member. The base member is configured to be attached to a structure. The clip member is configured to be removably attached to the base member. The clip member includes a light string cavity dimensioned to accommodate a string of lights. The clip member also includes an ornament member holding portion configured to accommodate a portion of the ornament member. The ornament member is illuminated by the string of lights located in the clip member providing a decorative effect to the structure to which the base member is attached. In one configuration, the ornament member is configured as a plurality of icicles thereby creating an illuminated icicle display.

9 Claims, 6 Drawing Sheets

ORNAMENTAL LIGHTING ASSEMBLY

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

The present invention relates to ornamental lighting assemblies. More specifically, the present invention relates to ornamental lighting assemblies that are attached to or within a structure to provide a decorative appearance to the structure, which may provide visually appealing appearances during the day and at night.

2. Description of Related Art

Lights are frequently attached to exteriors of structures as decorations to provide visually appealing decorative appearances to the buildings. For example, strings of lights are often attached to fascia or eaves of houses during holidays, such as Christmas. Recently, "icicle lights" have grown in popularity as ornamental decorations, particularly during the winter season. Icicle lights generally include a first series of lights spaced along the length of a main electrical cord, and a second series of lights on an electrical cord transversely oriented to the length of the main electrical cord. At night, icicle lights provide an illusion of lighted icicles hanging from the eaves of a house. However, during the day, the strings of lights and electrical cords are clearly visible and no longer provide the desired aesthetic qualities of icicles hanging from eaves.

Strings of lights are usually attached to an eave of a building by securing the light strings to one or more hangers which are attached to the eave of the building. For example, nails may be embedded in an eave of a house, and the light strings may be placed upon or otherwise secured to the nails. Unfortunately, nails embedded in the eaves have a tendency to reduce the aesthetic effects of the light strings, as well as the exterior of the house. As another example, clips are available which are configured to hold the string of lights near the eaves of the house. Clips may be embedded within the eave by urging a portion of the clip into the eave similar to nails. Or, clips may be attached to rain gutters which are typically located in proximity to an eave. Although clips tend to improve the aesthetic qualities of the decorations, clips still require a substantial amount of time and effort to install.

Accordingly, there remains a need for ornamental lighting assemblies which attempt to resolve problems of current systems. For example, lighting assemblies are needed which provide a desired decorative effect during both day and night. Lighting assemblies are also needed that are easy to install and uninstall, while not detracting from the aesthetic qualities of the decorations of the buildings to which they are attached.

SUMMARY OF THE INVENTION

The present invention attempts to resolve the problems of existing ornamental lighting assemblies. In accordance with the disclosure herein, an ornamental lighting assembly is described which provides a decorative effect during both day and night, and/or is easy to install and uninstall without substantially reducing the aesthetic qualities of the lighting assembly or building to which the lighting assembly is attached.

The ornamental lighting assembly includes a base member, a clip member, and an ornament member. The base member is configured to be attached or secured to a structure. The clip member is configured to be attached or secured to the base member. The ornament member is configured to be attached or secured to the clip member. The clip member includes a light string cavity dimensioned to accommodate a string of lights. When illuminated, the string of lights emits light causing illumination of the ornament member. Optionally, the ornamental lighting assembly may include an ornament member cover, which may be attached to the clip member to provide additional aesthetic properties to the ornamental lighting assembly.

Other features and advantages of the present invention will become apparent from the following more detailed description, taken in conjunction with the accompanying drawings, which illustrate, by way of example, the principles of the invention.

BRIEF DESCRIPTION OF THE FIGURES

The accompanying drawings illustrate the present invention. In such drawings.

DETAILED DESCRIPTION OF THE INVENTION

Figure 1:
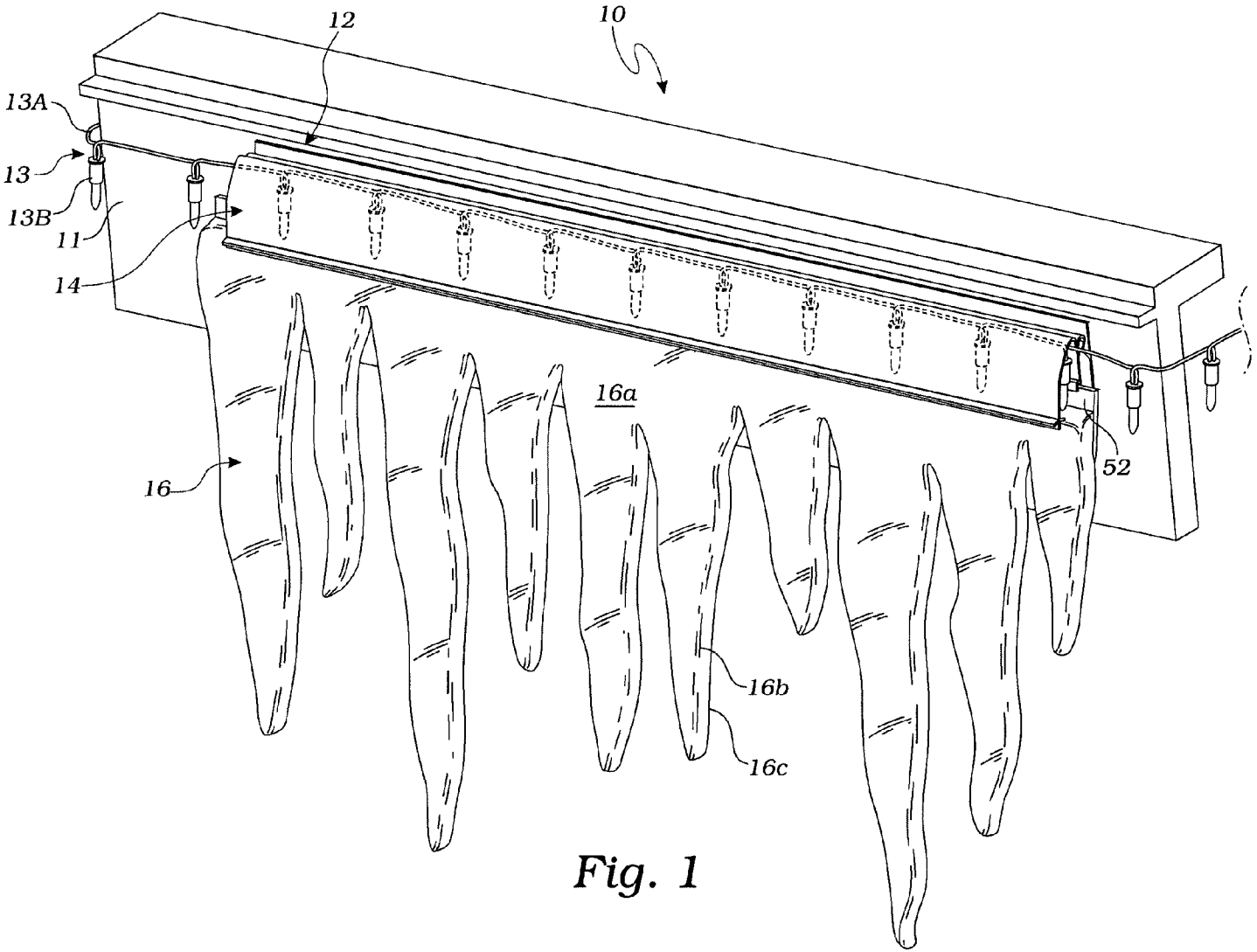
FIG. 1 is a perspective view of an ornamental lighting assembly in accordance with the present invention attached to a structure.

The above-described drawing figures illustrate the invention, an ornamental lighting assembly 10 adapted to be mounted on a structure 11 in conjunction with a string of lights 13. The ornamental lighting assembly 10 includes a front cover 14, a means for positioning the string of lights 13 behind the front cover 14 such that the string of lights 13 is concealed behind the front cover 14, and a means for mounting the front cover 14 to the structure 11. A means for operably associating an ornament member 16 with the front cover 14 enables the ornament member 16 to be illuminated by the string of lights 13.

In one embodiment, as shown in FIGS. 1–4, the front cover 14 is a clip member that substantially surrounds the string of lights 13 such that substantially all of the string of lights 13 is located in a light string cavity 40 and such that the string of lights 13 is not visible when the string of lights 13 is located in the light string cavity 40 and when the ornamental lighting assembly 10 is attached to the structure 11.

Figure 5:
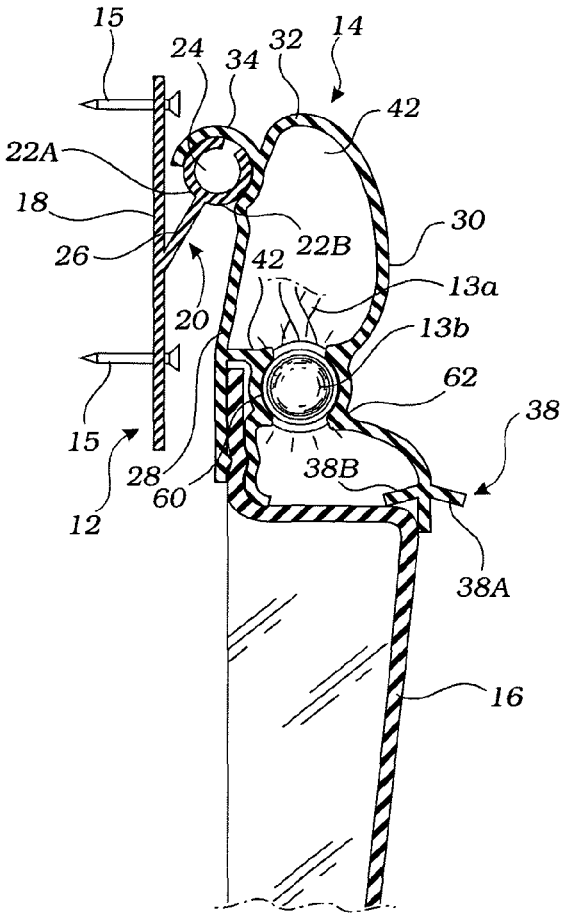
FIG. 5 is a sectional view similar to FIG. 3 illustrating an alternative embodiment of the clip member, wherein the clip member includes first and second light bulb gripping sections.

In one embodiment, the cavity 40 may be formed with a first leg section 28, a second leg section 30, and an intermediate section 32 connecting the first leg section 28 to the second leg section 30. In this embodiment, the means for positioning may be provided by the relative positioning of the first and second leg sections 28 and 30. In another embodiment, as shown in FIG. 5, the means for positioning is provided by a first and second light bulb gripping sections 60 and 62, described in greater detail below. The means for positioning may also include fastening the string of lights 13 to the structure 11 and positioning the front cover 14 over the lights 13. Other embodiments are described below; however, the invention should not be limited to these particular embodiments, but should include other alternative structures that may be devised by those skilled in the art.

The ornamental lighting assembly 10 includes a means for mounting the front cover 14 to the structure 11. In one embodiment, as shown in FIGS. 1–4, the means for mounting includes a base member 12 that is adapted to be secured to the structure 11 and serve as a mounting point for the front cover 14. In alternative embodiments, described below, the means for mounting may include other structures, including a hanger element upon which the front cover 14 is adapted to be hung. Other embodiments may be devised by those skilled in the art, and these alternative embodiments should be considered within the scope of the invention as claimed.

For purposes of this application, the term structure 11 should be construed to include any structure that might benefit from the ornamental lighting assembly 10, including homes, condos, apartments, commercial structures, and other structures. The ornamental lighting assembly 10 is preferably attached to the eaves of the house, although the ornamental lighting assembly 10 may be mounted elsewhere on or within any type of structure. Those skilled in the art may devise many different specific uses for the present invention, and these various uses should be considered within the scope of the invention as claimed below.

The string of lights 13 is a conventional item having an electrical cord 13A and a plurality of light emitting devices 13B, such as light bulbs. The light emitting devices 13B may be colored or clear. The string of lights used with the ornamental lighting assembly 10 might not be "icicle" lights, or in other words, the light strings do not include a first series of lights along the main electrical cord, and a second series of lights transversely oriented to the main electrical cord, but may be any type of lights, preferably lights that the consumer already owns. One advantage of using conventional light strings is that costs associated with purchasing new light strings are reduced. Another advantage of using conventional light strings is that energy costs are reduced relative to "icicle" lights due to the relatively lower number of light bulbs per unit length of the string of lights.

As shown in FIG. 1, the ornament member 16 is illustrated as a plurality of icicles. Because real icicles comprise frozen water, real icicles can typically transmit light, and are generally transparent. Since one object of the invention is to provide an ornamental lighting assembly that looks like icicles, the illustrated ornament member 16 preferably includes a generally transparent body. The ornament member 16 is illustrated as being made of a transparent material which transmits light so that when the ornament member 16 is illuminated, such as at night, the outline of the shape of the ornament member 16 is illuminated. Preferably, the non-peripheral regions of the ornament member 16 will have a reduced illumination relative to the peripheral regions of the ornament member 16 when being illuminated by the light emitting devices 13B. The ornament member 16 includes a terminal edge 16*c* that is adapted to scatter light from the string of lights 13. The terminal edge 16*c* may be painted with a glow-in-the-dark paint to further increase the ornamental effect.

The ornament member 16 is typically made from a polymeric material, such as plastics and/or plastic composites. The ornament member should be relatively light weight to reduce the potential of falling from the clip member, and may be relatively flexible to facilitate insertion and removal from the clip member without breaking. An advantage of using an ornament member having a predetermined, fixed or static configuration and visual appearance is that the ornament member 16 provides a decorative effect to the structure 11 to which it is attached during both the day and the night. In other words, the illustrated ornament member 16 provides an illusion of icicles hanging from the structure 11 during the day as well as at night. This is in contrast to existing "icicle" lights which may provide an illusion of icicles at night, but during the day only look like hanging lights with no particular configuration.

Figure 2:
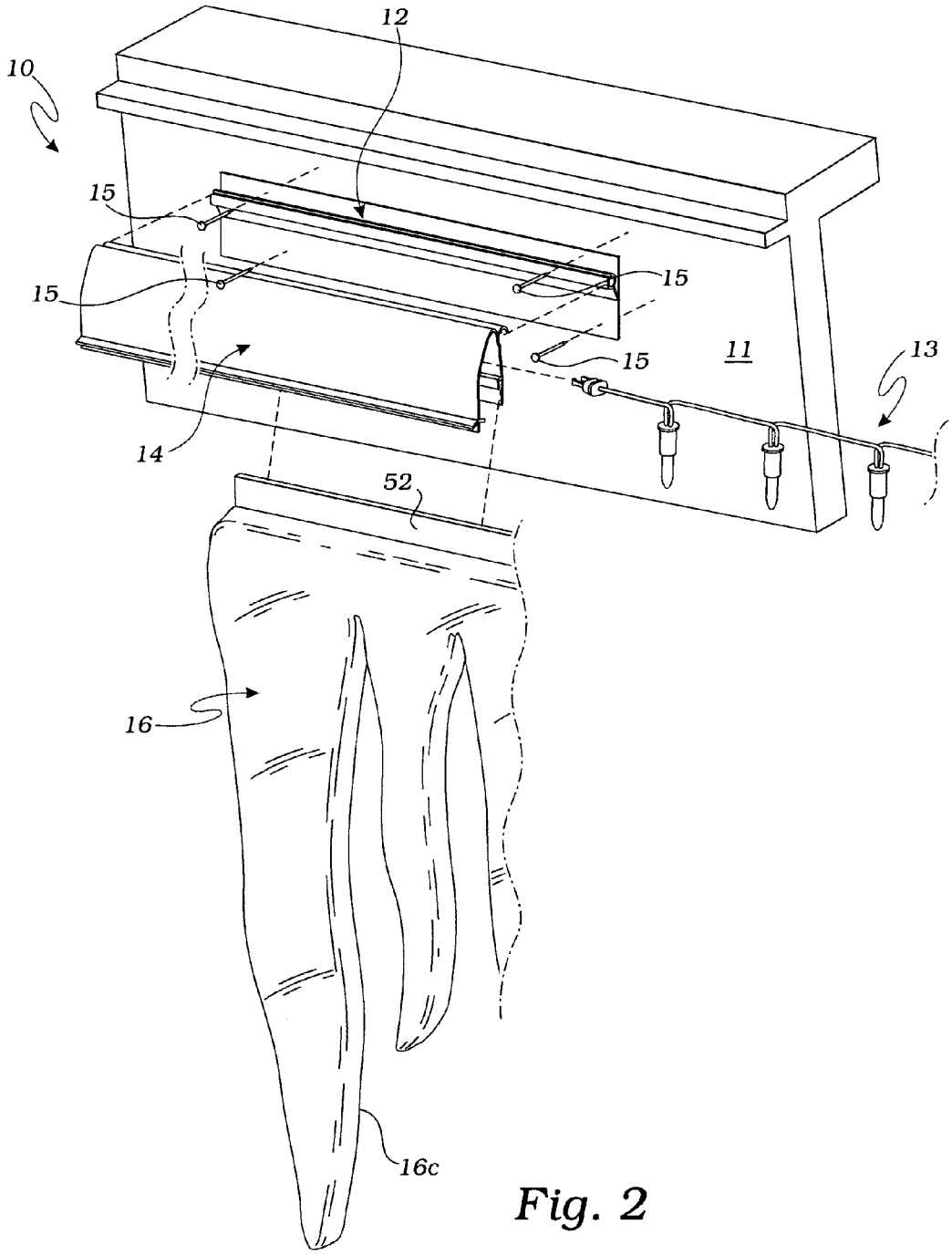
FIG. 2 is an exploded perspective view of a portion of the ornamental lighting assembly of FIG. 1.

As shown in FIG. 2, the base member 12 is secured to the structure 11 by a fastener 15, which is inserted through a portion of the base member 12 into the structure 11. In the illustrated embodiment, the fastener 15 is a nail. In other embodiments, the fastener member may be a device that can penetrate through the base member and be secured into the structure 11 to provide a relatively permanent attachment of the base member 12 to the structure 11. For example, the fastener member 15 may be a screw, a pin, or a tack, among other things. In additional embodiments, the fastener member may include an adhesive, such as a glue, which permits the base member 12 to be securely attached to the structure 11. In reference to the disclosure herein, "relatively permanent" refers to an attachment that is secure enough to prevent inadvertent dislodgement of the item being attached. However, as understood by persons of ordinary skill in the art will understand, although an item, such as base member 12, may be relatively permanently attached to the structure 11, the base member 12 may be removed from the structure 11 by removing the fastener 15.

The base member 12 generally has a length corresponding to at least a portion of the length of the structure 11 (particularly, the length of the eaves), and a height that is generally shorter than the length. The base member 12 is typically provided as a plurality of elongated strips that together have a length substantially equal to the length of the structure 11; however, the base member 12 may also have a substantially shorter length, if desired. The base member 12 is typically made of a plastic or plastic-like material. To reduce adverse aesthetic effects associated with installing the base member 12, which may detract from the aesthetic effects provided by the ornament assembly 10, the base member 12 is typically made of a material that visually blends in with the structure 11 and does not rust. For example, the base member 12 may be made of a transparent plastic, so that the base member is not easily noticed. Or, the base member 12 may be made of a colored plastic, in which the color corresponds to the color of the structure 11. By manufacturing the base member 12 from a material that does not significantly affect the aesthetic qualities of the structure 11 to which it is attached, the base member 12 can remain attached to the structure 11 for extended periods of time, such as for several months or years, without needing to be removed when the ornament member 16 is not being used. Advantageously, the effort to attach the ornament assembly 10 to the structure 11 is greatly reduced relative to existing ornament assemblies since the base member 12 can remain attached to the structure for multiple seasons.

In addition, as shown in FIG. 2, and as discussed herein, the clip member 14 is easily attached to the base member 12. Briefly, the clip member 14 includes a portion which is structured to engage with a portion of the base member 12. The engagement of the clip member 14 and the base member 12 is relatively permanent. For example, the clip member 14 may be snapped into engagement with the base member 12 so that the clip member 14 is not easily dislodged from the base member 12. However, the clip member 14 can still be removed from the base member 12 by unsnapping the clip member 14 from the base member 12. Alternatively, the clip member 14 could be slid along the length of the base member 12 to obtain the desired engagement, and when desired, the clip member 14 could be removed from the base member 12 by sliding the clip member 14 off of the base member 12. Similar to the base member 12, the clip member 14, either alone or in combination, generally has a length that is substantially equal to the length of the structure 11. The clip member 14 is preferably substantially equal in length to the base member 12. The clip member 14 also has a height that is typically less than the length of the clip member 14.

As discussed herein, the clip member 14 is shaped to define a cavity 40 or lumen for retaining the string of lights 13, as shown in FIGS. 1 and 2. Thus, the clip member 14 also functions as a container or holder for the string of lights 13. The clip member 14 is constructed such that the string of lights 13 is not readily apparent when viewing the ornamental lighting assembly 10. In other words, the string of lights 13 is hidden from view when the ornamental lighting assembly is installed. It will be understood however, that light may be visible through the clip member 14 when the light emitting devices 13B are emitting light. By reducing the visible exposure of the string of lights 13, the aesthetic qualities of the ornamental lighting assembly are improved relative to existing ornamental lighting assemblies in which the string of lights 13 is visible. In addition, the clip member 14 substantially surrounds the string of lights 13 to reduce exposure of the string of lights 13 to environmental conditions, such as rain and snow. Since the light emitting devices may generate heat and since electricity is being passed through the string of lights 13, it may be preferred to provide a fire retardant material with the clip member 14. The clip member 14 may be made from a heat resistant and/or fire retardant material, or it may include a heat resistant and/or fire retardant coating, for example, on the interior of the cavity of the clip member 14.

As discussed herein, and as shown in FIGS. 1 and 2, the ornament member 16 includes an attachment region 52 configured to engage with the clip member 14 so that the ornament member 16 is fixedly retained by the clip member 14 when the ornament assembly 10 is attached to the structure 11. The ornament member 16 typically extends from the clip member 14, and is positioned below the string of lights 13 that is located in the cavity 40 of the clip member 14. Because the ornament member 16 is made of a light transmitting material, light emitted from the light bulbs of string of lights 13 passes through the ornament member 16 and illuminating the ornament member 16. Preferably, the illumination primarily occurs at the periphery to provide an outline reflection of the ornament member 16. As indicated herein, the string of lights 13 is typically hidden from view since the string of lights 13 is placed in a cavity of the clip member 14, but the light bulbs of the string of lights 13 still provide a desired illuminative effect of the ornament member 16.

Figures 3, 4:
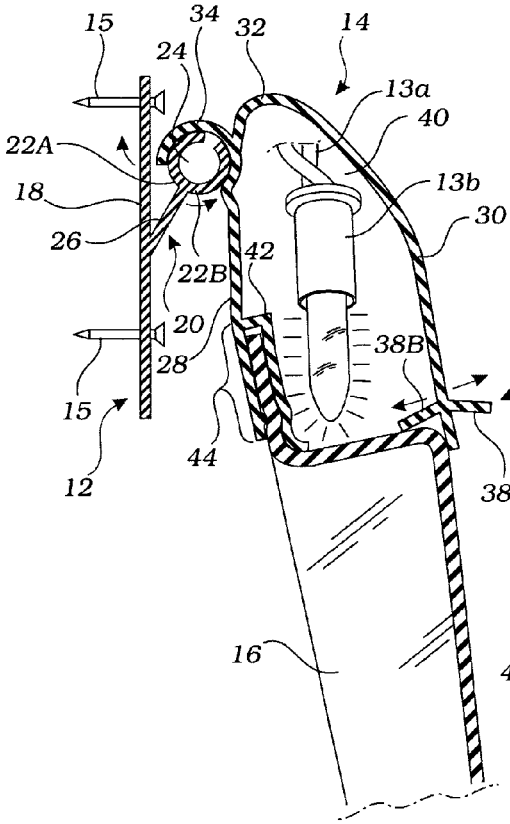
FIG. 3 is a sectional view of the ornamental lighting assembly of FIG. 1 with a light emitting device located in a cavity of a clip member.
FIG. 4 is a sectional view similar to FIG. 3 illustrating a flexing action of a clip member.

Referring to FIGS. 3 and 4, details of the preferred structure of the base member 12, the clip member 14, and the ornament member 16 will be described. As shown in FIG. 3, the base member 12 preferably includes a substrate 18 and a clip coupling element 20. The clip coupling element 20 extends from a surface of the substrate 18. The clip coupling element 20 is illustrated as including a pair of arms, a first arm 22A and a second arm 22B, coupled to a spacer 26. The arms 22A and 22B define a cavity 24. The arms 22A and 22B are in a generally C-shaped configuration to define a generally circular cavity. The clip coupling element 20 is illustrated as extending from the substrate 18 at a non-perpendicular angle, and more specifically, the clip coupling element 20 extends upwardly at an acute angle relative to the substrate 18. The clip coupling element 20 and the substrate 18 are preferably formed of a single material, such as a plastic. Each of the arms 22A and 22B may be somewhat flexible to facilitate the engagement between the coupling element 20 and the clip member 14, as discussed herein.

The base member attachment element 34 extends from the clip member 14, preferably from the first leg section 28 at a region in proximity to the intermediate section 32. In the illustrated embodiment, the intermediate section 32 is generally located at the top of the clip member 14 when the clip member is attached to the base member 12. The base member attachment element 34 generally defines a C-shaped structure, as shown in FIG. 4. The C-shaped structure 34 has a size that approximately corresponds to the outer diameter of the arms 22A and 22B of the clip coupling element 20. The base attachment element 34 is partially flexible to facilitate the engagement with the coupling element 20 of the base member 12.

The second leg section 30 of the clip member 14 includes a protrusion assembly 38 located at an end of the second leg section 30. The protrusion assembly 38 is illustrated as comprising an extension protrusion member 38A, and a light string retaining member 38B. As shown in FIG. 4, the extension protrusion member 38A is effective to permit the second leg section 30 to be flexed or lifted away from the first leg 28. Extension protrusion member 38A is illustrated as an extension of the second leg section 30 that is oriented at an angle to the second leg section 30, and projects away from the first leg 28. Light string retaining member 38B is effective to retain the string of lights 13 within the clip member 14. More specifically, the clip member 14 includes a cavity 40 bounded by the first leg section 28, the second leg section 30, and the intermediate section 32. Thus, the light string retaining member 38B is effective to retain a string of lights 13 in the light string cavity 40. Typically, the retention of the string of lights 13 is facilitated by providing a ledge or similar surface configuration near the cavity 40 for portions of the string of lights 13 to be placed against.

As shown in FIGS. 3 and 4, in one embodiment the means for operably associating the ornament member 16 includes an attachment region 54 that extends from the ornament member 16, the attachment region 54 being adapted to engage an ornament attachment portion 44 of the front cover 14. In one embodiment, the ornament attachment portion 44 is located at an end of the first leg section 28. The ornament attachment portion 44 is illustrated as including a first coupling member 42 and a second coupling member 48, and a cavity 46. More specifically, the first coupling member 42 extends from the first leg section 28 into the light string cavity 40 to form the cavity 46 that is configured to accommodate a portion of the ornament member 16, as discussed herein. The second coupling member 48 also extends from the first leg section 28 into the light string cavity 40, but the second coupling member 48 does not extend as far as the first coupling member 42. The first coupling member 42 is illustrated as an arm extending from the first leg section 28 with a first portion oriented substantially perpendicular to the first leg section 28 and a second portion oriented substantially parallel to the first leg section 28. The second coupling member 48 is illustrated as a rib protruding from the first leg section 28.

As shown in FIG. 4, the attachment region 52 is configured to be inserted into the ornament attachment portion 44 of the clip member 14. The attachment region 52 may include a cut-out 54 which is positioned to accommodate the second coupling member 48 of the ornament attachment portion 44. The ornament member 16 also includes a light transmitting surface 56 oriented at an angle to the first leg 28 and the second leg 30 to define a bottom of the light string cavity 40, when the ornament assembly 10 is assembled.

In another embodiment, as shown in FIGS. 7–10, the means for operably associating the ornament member 16 includes an ornament hook 78 extending from the ornament member 16. The ornament hook 78 is adapted to hang upon an aperture 80 through the front cover 14, as described in greater detail below. While these specific embodiments are described in detail herein, the scope of the claimed invention should also include alternative embodiments that can be devised by those skilled in the art.

The base member 12, clip member 14, ornament member 16, and ornament cover may each be made using conventional methods known and practiced by persons of ordinary skill in the art. For example, the various elements of the ornamental lighting assembly 10 may be injection molded or thermoformed using conventional techniques.

The ornamental lighting assembly 10 is typically installed by securing the base member 12 to the structure 11. The base member 12 is generally secured to the structure in a manner that does not compromise the aesthetic qualities of the structure. For example, and as shown in FIG. 3, the base member 12 may be nailed to the structure 11, typically to the fascia or eaves of a house, by inserting the fastener 15 through the substrate 18 of the base member 12 into the structure 11. The base member 12 may be attached to the structure, along the edge of the eave, so that the base member 12 follows the contour of the structure 11. Because the base member 12 typically is manufactured from materials that do not compromise or negatively affect the aesthetic qualities of the house, for example, transparent materials, or colored materials that have a similar color to the structure 11, the base member 12 can be attached to the structure 11 for extended periods of time, for example, several years or more. However, if desired, the base member 12 can be removed and reattached as may be desired.

The clip member 14 is installed to the structure 11 by engaging the base attachment portion 34 with the coupling element 20 of the base member 12. In certain situations, the base attachment portion 34 is snapped on to the coupling element 20. In other situations, the clip member 14 may be attached to the base member 12 by sliding the base attachment portion 34 over the coupling element 20 along the length of the base member 12. As discussed herein, the clip member 14, including the base attachment portion 34, are manufactured from a resilient or somewhat flexible material. Thus, the base attachment portion 34 exerts a biasing force on the coupling element 20 of the base member 12 to retain the clip member 14 on the base member 12. The biasing force is sufficient to prevent the clip member 14 from being inadvertently dislodged from the base member 12, such as by wind, or accidental bumping, but also permits the clip member 14 to be readily disengaged from the base member 12 without causing the base member 12 to unattach from the structure 11. Thus, when the lighting assembly 10 is desired to be used, the clip member 14 can be easily attached to the base member 12, and when the lighting assembly 10 is desired to be removed, the clip member 14 can be easily unattached from the base member 12.

After the clip member 14 has been attached to the base member 12, the ornament member 16 can be attached to the clip member 14. Typically, this attachment is accomplished by inserting a first end 52 of the ornament member 16 between the first leg section 28 and the second leg section 30 of the clip member 14. In the illustrated embodiment, the attachment region 52 of the ornament member 16 is inserted into the ornament receiving cavity 44 of the clip member 14. In this manner, the cut-out 54 of the ornament member 16 receives the second coupling member 48 of the ornament holding portion 44, and is thereby retained by the clip member 14 to the structure 11.

The string of lights 13, or multiple strings, may be placed in the light string cavity 40 of the clip member 14 before or after the ornament member 16 is attached. In certain situations, the string of light 13 may be placed in the light string cavity 40 by inserting one end of the string of lights 13 into one end of the light string cavity 40 and pushing or pulling the light strings 13 through the light string cavity 40 along the length of the clip member 14. In other situations, the light strings 13 may be placed in the light string cavity 40 by extending the second leg section 30 of the clip member 14 away from the first leg section 28 so that the light string cavity 40 is enlarged, as shown in FIG. 4. With the second leg section 30 extended, the string of lights 13 may then be placed in the light string cavity 40 in portions. After a portion of the string of lights 13 is placed in the light string cavity 40, the second leg 30 section may be released so that the second leg section 30 may assume its native or relaxed configuration, such as in proximity to the first leg section 28 of the clip member 14.

Figure 6:
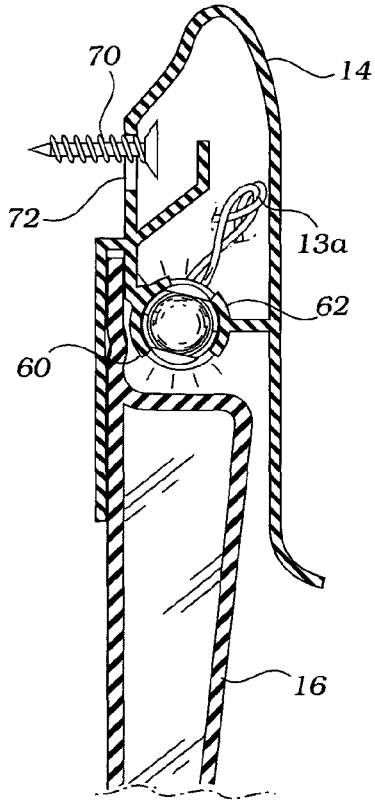
FIG. 6 is a sectional view of an alternative embodiment thereof.
Figure 8:
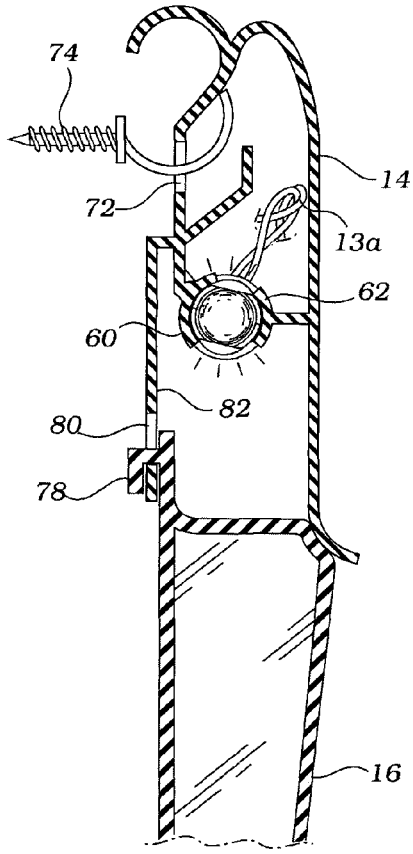
FIG. 8 is a sectional view thereof taken along line 8—8 in FIG. 7.
Figures 9, 10:
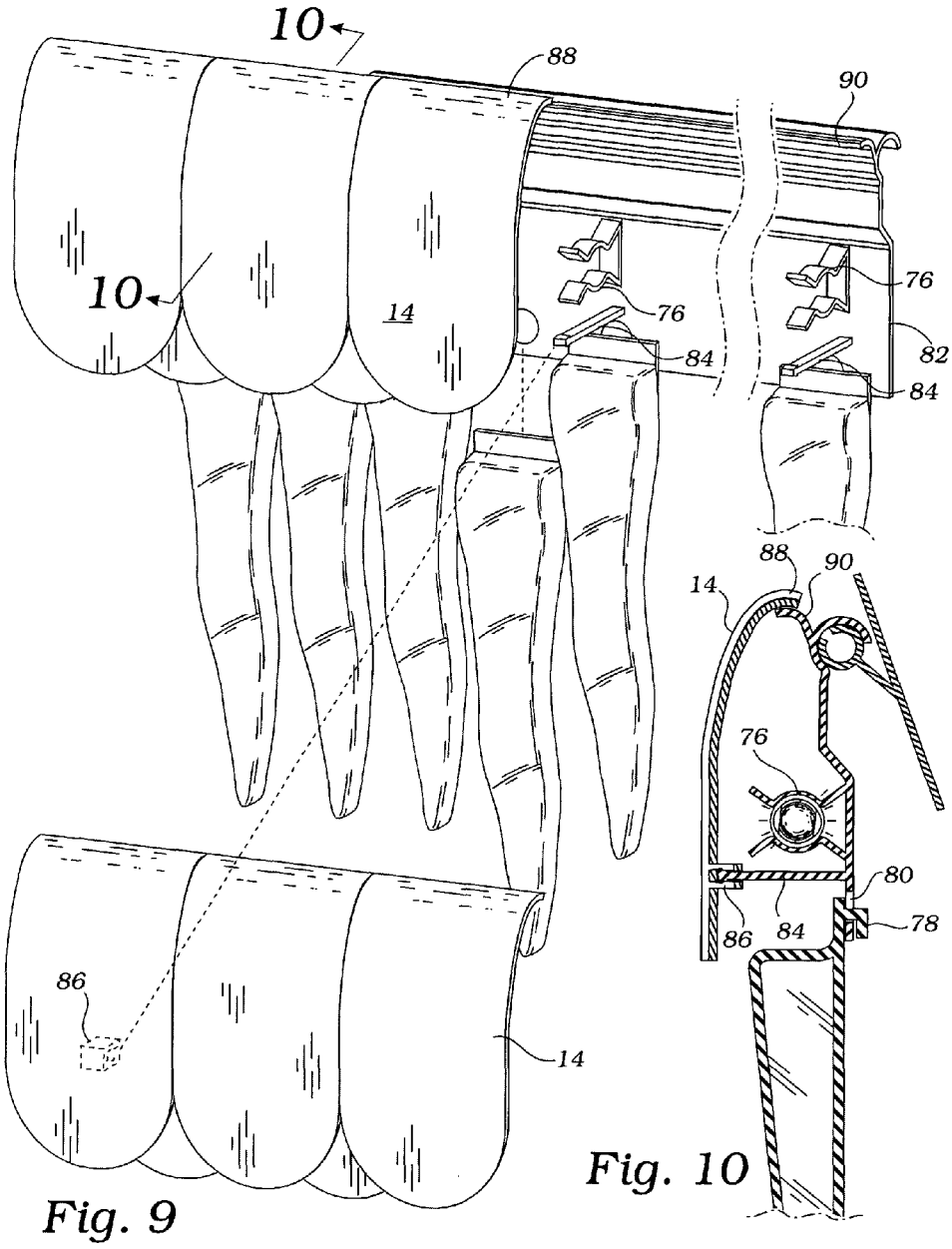
FIG. 9 is a front perspective, partially exploded view of another alternative embodiment of the ornamental lighting assembly.
FIG. 10 is a sectional view thereof taken along line 10—10 in FIG. 9.

As shown in FIG. 5, in one embodiment the means for positioning is a light clamping portion located behind the front cover 14. In this embodiment, the light clamping portion is provided by first and second light bulb gripping sections 60 and 62 formed as part of the first and second leg sections 28 and 30. The first and second light bulb gripping sections 60 and 62 function to clamp the light emitting devices 13B of the string of lights 13, thereby holding them in their proper position. Alternative embodiments of the first and second light bulb gripping sections 60 and 62 are shown in FIGS. 6 and 8. Yet another alternative embodiment of the light clamping portion, a clip 76, is illustrated in FIGS. 9 and 10.

To remove the ornament lighting assembly 10 from the structure 11 of the house, the ornament member 16 is removed by disengaging it from the clip member 14. In certain situations, extending the second leg section 30 from the first leg section 28 facilitates the release of the ornament member 16 and/or ornament cover from the clip member 14. The clip member 14 may then be released from the base member 12 by rotating the clip member 14 off of the base member 12 so that the base attachment portion 34 unsnaps from the coupling element 20 of the base member 12, or by sliding the clip member 14 off the base member 12 along the length of the base member 12. The string of lights 13 may be removed, or may be left in the light string cavity 40 for future use of the lighting assembly 10.

A reflector or a reflective coating may be provided to the inner surface of the light string cavity 40 to provide additional illumination effects of the lighting assembly 10. Other reflectors may include one or more mirror-like devices located within the light string cavity 40. In addition, or alternatively, the clip member 14 may be constructed to display the ornament member 16 from an interior surface (not shown) of an eave of the structure 11. In such embodiments, the base member 12 could be attached to the interior surface (not shown) of the eave of the structure 11 so that it is completely invisible from the exterior of the structure 11. In such a configuration, it may be desirable to provide the ornament cover 16 that is configured to be positioned between the ornament member 16 and the first leg section 28 of the clip member 14, as compared to being positioned between the ornament member 16 and the second leg section 30 of the clip member 14.

Furthermore, other ornamental designs or configurations can be used in the manufacture of the ornament member 16. For example, the ornament member 16 may be similar to a garland, or may have a holiday or season specific configuration, such as for Halloween, Thanksgiving, or Easter.

FIG. 6 is a sectional view of an alternative embodiment of the ornamental lighting assembly 10. In this embodiment, the means for mounting includes a hanger element 70 that is adapted to engage the structure 11 and removably engage a hanging aperture 72 of the front cover 14. The hanger element 70 may include a screw, as shown in FIG. 6, a hook 74, as shown in FIG. 8, or other similar mounting mechanism, nail, or similar device. Obviously, those skilled in the art may bevies alternative means for mounting the front cover 14, and such alternative structures should be considered within the scope of the claimed invention.

Figure 7:
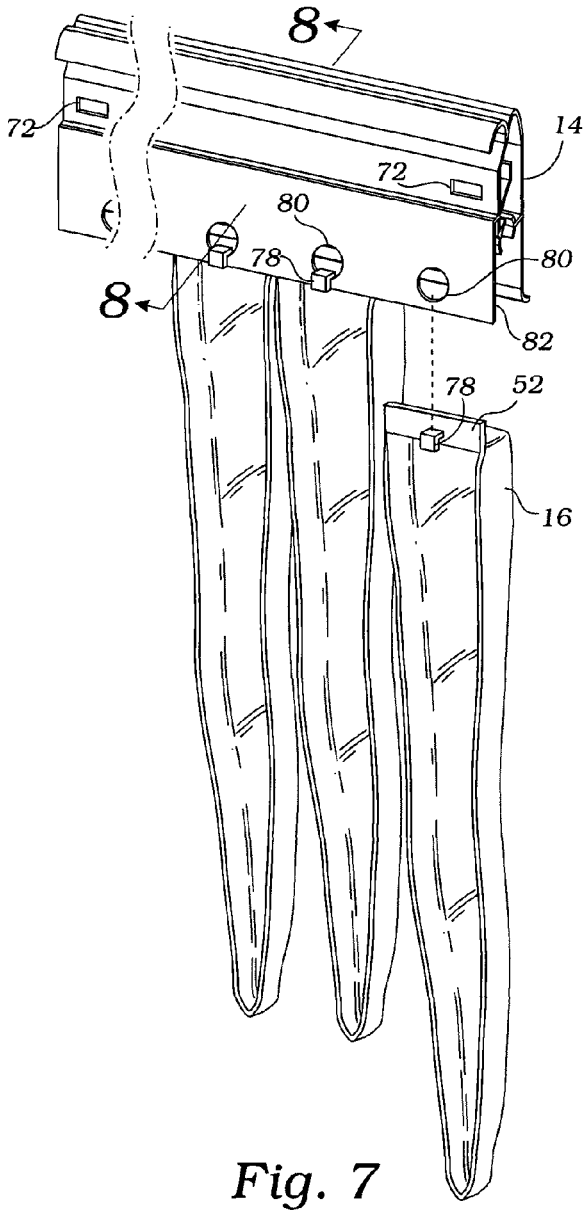
FIG. 7 is a rear perspective view of another embodiment of the ornamental lighting assembly.

FIGS. 7 and 8 illustrate another embodiment of the ornamental lighting assembly 10. In this embodiment, the attachment region 52 of the ornament member 16 includes an ornament hook 78 that is adapted to fit through and hang from an aperture 80 of the front cover 14. The front cover 14 preferably includes a rear sidewall 82 that defines the aperture 80. In this embodiment, the ornament member 16 may include a plurality of individual icicle members, each of the plurality of individual icicle members 16 being adapted to be hung from the front cover 14.

FIGS. 9 and 10 illustrate another alternative embodiment of the ornamental lighting assembly 10. In this embodiment, the front cover 14 is in the form of an ornament cover that may be attached to a rear sidewall 82. The method of installation will depend on the configuration of the ornament cover 14 and the rear sidewall 82, among other things. In the illustrated embodiment, the rear sidewall 82 includes an attachment finger 84 that is configured to be inserted into a receiver 86 of the ornament cover 14.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An ornamental lighting assembly adapted to be mounted on a structure in conjunction with a string of lights, the ornamental lighting assembly comprising:

a front cover;

a means for positioning the string of lights behind the front cover such that the string of lights is concealed behind the front cover;

a means for mounting the front cover to the structure;

an ornament member having a predetermined shape that provides an ornamental impression;

a means for operably associating the ornament member with the front cover such that the ornament member is illuminated by the string of lights;

wherein the front cover is a clip member that substantially surrounds the string of lights such that substantially all of the string of lights is located in a light string cavity and such that the string of lights is not visible when the string of lights is located in the light string cavity and when the ornamental lighting assembly is attached to the structure.

2. The ornamental lighting assembly of claim 1, wherein the clip member includes a first leg section and a second leg section, the second leg section flexibly coupled to the first leg section to form the light string cavity, and wherein the means for positioning the string of lights is provided by the relative positioning of the first and second leg sections.

3. The ornamental lighting assembly of claim 1, wherein the means for positioning is a light clamping portion located behind the front cover.

4. The ornamental lighting assembly of claim 1, wherein the ornament member is formed in the shape of icicles.

5. The ornamental lighting assembly of claim 1, wherein the means for mounting includes a hanger element that is adapted to engage the structure and removably engage a hanging aperture of the front cover.

6. The ornamental lighting assembly of claim 1, wherein the ornament member includes a plurality of individual icicle members, each of the plurality of individual icicle members being adapted to be operably associated with the front cover.

7. The ornamental lighting assembly of claim 1, wherein the means for operably associating the ornament member includes an attachment region extending from the ornament member, the attachment region being adapted to engage an ornament attachment portion of the front cover.

8. The ornamental lighting assembly of claim 1, wherein the means for operably associating the ornament member includes an ornament hook extending from the ornament member, the ornament hook being adapted to hang upon an aperture of the front cover.

9. The ornamental lighting assembly of claim 1, wherein the ornament member includes a terminal edge that is adapted to scatter light from the string of lights.

* * * * *